United States Patent [19]

Van Wersch et al.

[11] 4,364,784

[45] Dec. 21, 1982

[54] METHOD AND APPARATUS FOR CONTINUOUS APPLICATION OF FOAM TO A PLANAR TEXTILE STRUCTURE

[75] Inventors: Kurt Van Wersch, Wegberg; Manfred Pabst, Cologne, both of Fed. Rep. of Germany

[73] Assignee: A. Monforts, Monchen-Gladbach, Fed. Rep. of Germany

[21] Appl. No.: 192,302

[22] Filed: Sep. 30, 1980

[30] Foreign Application Priority Data

Oct. 1, 1979 [DE] Fed. Rep. of Germany ..... 2939797

[51] Int. Cl.[3] ..... B32B 31/16

[52] U.S. Cl. ..... 156/78; 156/231; 156/285; 156/497; 156/500; 156/540

[58] Field of Search ..... 156/540, 78, 285, 231, 156/500, 497

[56] References Cited

U.S. PATENT DOCUMENTS

| | | | |
|---|---|---|---|
| 2,628,654 | 2/1953 | Alderfer | 156/78 X |
| 3,042,573 | 7/1962 | Roberts | 156/285 |
| 3,165,432 | 1/1965 | Plaskett | 156/285 X |

*Primary Examiner*—Evan K. Lawrence

*Attorney, Agent, or Firm*—Herbert L. Lerner; Lawrence A. Greenberg

[57] ABSTRACT

Method of continuously applying a foamed treatment medium to a planar textile structure which includes applying the foam directly to a planar follower guidable synchronously into areal contact with the planar textile structure, and transfering the foam from the planar follower into the planar textile structure by applying vacuum, and apparatus for carrying out the method.

8 Claims, 2 Drawing Figures

Figure 1:
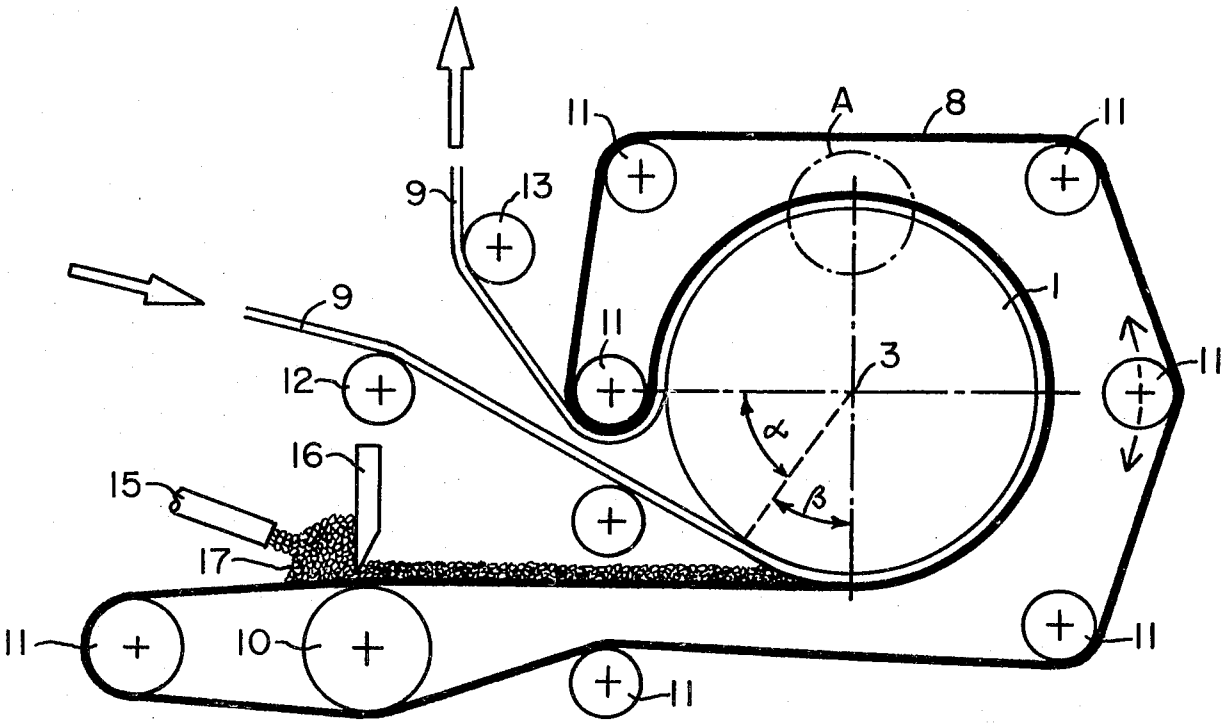

METHOD AND APPARATUS FOR CONTINUOUS APPLICATION OF FOAM TO A PLANAR TEXTILE STRUCTURE

The invention relates to a method for the continuous application of foamed treatment medium to planar textile structures. Depending upon the type of treatment medium, the application and the subsequent destruction of the foam can be followed by a fixation of the treatment medium on the textile material. The invention relates further to apparatus for performing the method. Finishing media of all kinds such as dyes, natural and synthetic resins and the like insofar as foaming, especially in aqueous solution, is at all possible, are applicable as treatment media.

In a heretofore known German Published Non-Prosecuted Application DE-OS No. 27 15 862, textile finishing media which are basically liquid can be wiped onto the respective textile web of material in foam form by means of a knife or a wiper, and very uniform foam applications can be obtained. In the course of rationalization, there is a striving or endeavor to employ foams having a concentration of the respective treatment medium which is as high as possible. This means, accordingly, thin, so-called heavy foam layers.

In wiping foam onto webs of material to be treated therewith, difficulties are encountered if open material or material structured in some manner are to be coated with the foam. In the case of relief material or mesh material, the raised parts of the surface of the web of material obviously receive a foam layer of lesser thickness than do the depressed areas when the foam is wiped on. The consequently different treatment may already become intolerable when thin, heavy foam layers are applied. In the case of open articles such as curtains, wiping-on also for thick foam layers hardly makes any sense. If the web of material is standing still, non-uniformities of the treated web of material further result. If very thin and/or accordingly highly concentrated foams are to be wiped on, a special device for lifting the wiper when it passes seams must further be provided.

It is an object of the invention to provide an improved method as well as corresponding apparatus for applying a foamed treatment medium to a planar structure, which permits uniform application of the foam even when the articles are structured in some manner or are open, and does not cause non-uniform treatment in the event of a temporary standstill of a web of material to be foamed, or when a seam in the web of material is passed.

With the foregoing and other objects in view, there is provided, in accordance with the invention, a method of continuously applying a foamed treatment medium to a planar textile structure, which comprises applying the foam directly to a planar follower guidable synchronously into areal contact with the planar textile structure, and transferring the foam from the planar follower into the planar textile structure by applying vacuum or negative pressure thereto. According to the invention, the foamed treatment medium is applied to the planar follower or backing cloth at normal pressure and is transferred from the planar follower to the planar textile structure by vacuum or negative pressure.

With the method according to the invention, the foam is applicable to the backing cloth follower by a wiper or any other means for applying a foam which permits the formation of a uniformly thick foam layer. Due to the fact that, in accordance with the invention, the foam is not applied directly to the web of material to be foam-coated, but is instead initially applied to a backing cloth follower which can subsequently be brought into contact with a web of material synchronously and areally, a completely uniform foam application can be achieved regardless of any structuring of the goods and even with open articles.

The effect desired according to the invention becomes particularly advantageous if the foam, after being applied to the backing cloth follower which is especially air-tight or air-impermeable, is to be transferred through vacuum from the backing cloth follower, after the latter has joined or run together with the web of material, onto and into the planar structure of the web of material in an evacuated space or chamber. If a pressure (for example, about 0.01 to 0.1 bar absolute) is selected so that it is low compared to the internal pressure (for example about 1 bar) of the bubbles of foam, the bubbles burst completely and almost instantaneously when they enter the vacuum space or chamber. Before they burst, however, the foam bubbles which originally had a diameter of about 0.001 to 0.1 millimeters cannot become larger in direction toward the (impermeable) backing cloth follower and, therefore, wet the interior of the planar structure to be treated. Depending upon the layer thickness of the applied foam and the quality of the web of material treated, the latter or the fiber content thereof can be provided fully or partially with the treatment medium.

In order to ensure that the foam uniformly applied to the backing cloth follower remains distributed without any disturbance of this uniformity, especially without any backing-up or damming when the backing cloth follower areally joins or runs together with the web of material to be treated and when it enters the vacuum space or chamber, it is advantageous for a relatively small suction force to be exerted on the foam lying on the backing cloth follower from the planar structure beforehand just before the latter merges or runs together with the backing cloth follower. The suction force or pull should be only strong enough so that it prevents backing-up or damming of the foam; a sucking of the foam into the web of material, on the other hand, is unnecessary or undesirable. Through the aforedescribed inlet area, what is accomplished is that the foam is drawn by the suction pull acting thereon into the inlet gap of the vacuum space, which is formed at the location where the web of material and the backing cloth follower run together, and can therefore not back up or dam ahead of the inlet gap.

In accordance with another mode, the method invention comprises guiding the planar follower, which is air-impermeable, over a drum having, at the surface thereof, a support layer subjected to vacuum, guiding the planar textile structure between the shell of the drum and the planar follower and running the planar textile structure, even considerably before the planar follower, onto the drum shell, and exerting suction pressure on the foam disposed on the planar follower from a peripheral section of the drum disposed ahead of a line at which the planar follower runs up on the drum shell. In principle, a device can be used for carrying out this method such as has been described, for example, in German Published Prosecuted Application DE-AS No. 25 02 149, wherein, however, a cover layer of fine capillaries is disposed on the supporting wire screen surrounding the drum.

In accordance with another aspect of the invention, there is provided, an apparatus for performing the method of continuously applying a foamed treatment medium to a planar textile structure comprising a drum having, at the shell surface thereof, an evacuatable support layer, an air-impermeable planar follower spanning part of the drum periphery for guiding the planar structure on the drum shell surface, the planar follower having an inlet section supported by at least one roller, and a wiper disposed opposite the one roller for uniformly distributing foamed treatment applied to the planar follower region preceding the wiper.

In accordance with a further feature of the invention, the drum has a peripheral section forward of a run-up line at which the planar follower runs up on the drum, the peripheral section being uncovered by the planar follower yet subjectible to suction pull.

In accordance with a concomitant feature of the invention, the air-impermeable planar follower is formed of smoothly ground rubber.

Other features which are considered as characteristic for the invention are set forth in the appended claims.

Although the invention is illustrated and described herein as embodied in method for continuous application of foam to a planar textile structure and apparatus for carrying out the method, it is nevertheless not intended to be limited to the details shown, since various modification and structural changes may be made therein without departing from the spirit of the invention and within the scope and range of equivalents of the claims.

Figure 2:
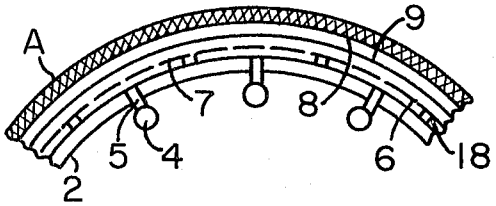

The construction and method of operation of the invention, however, together with additional objects and advantages thereof will be best understood from the following description of specific embodiments when read in connection with the accompanying drawings, in which:

FIG. 1 is a diagrammatic elevational view of apparatus for implementing the method for continuous application of foam to a planar textile structure in accordance with the invention; and FIG. 2 is an enlarged fragmentary sectional view of FIG. 1 showing the region A thereof.

Referring now to the drawing, there is shown in FIGS. 1 and 2, an embodiment of the apparatus for implementing the method according to the invention which includes a cylinder shell or casing 1 with a multiplicity of holes 5 which can be connected on the inside of the cylinder 2 to a vacuum or negative pressure space or chamber or a non-illustrated vacuum pump, by means of lines 4 which extend, for example, parallel to the cylinder axis 3, for generating a vacuum or negative pressure; a support layer 7 which evenly or uniformly distributes or equalizes the vacuum on the drum surface 6; and an endless follower or backing cloth 8 which is air-impermeable and is pressed by the vacuum against the cylinder surface 6 or the support layer 7, respectively, with an inlet section, the planar textile structure 9 which is to be treated being guided at the drum surface 6 between the backing cloth follower 8 and the support layer 7. The backing cloth follower 8 runs over rollers 10 and 11 on the one side and the surface 6 of the cylinder shell 1 on the other side. It is advantageous to connect to the non-illustrated vacuum pump only those lines 4 for feeding the vacuum to the surface 6 of the cylinder shell 1 which are provided for supplying the region of the drum surface 6 covered by the backing cloth follower 8 at times i.e. when the cylinder revolves. According to FIG. 1, the sector of the periphery of the cylinder shell 1 encompassed within the angles $\alpha+\oplus$ should, according to this rule, not be subjected to the vacuum i.e. the lines 4 belonging to this sector of the cylinder periphery would have to be decoupled from the connection to the vacuum chamber or space or the vacuum pump by means of a revolving control head.

According to the illustrated embodiment, the planar textile structure 9 to be treated is introduced by means of a roller 12 between the support layer 7 on the cylinder surface 6 and the backing cloth follower 8 and is drawn over one of the rollers 11 and the roller 13 out of the apparatus, for example, to a plaiting-down device.

According to the invention, the foam provided for treating the planar structure 9, which may be a dyeing agent as well as some other treatment medium or agent is not applied directly to the planar structure 9, but first to the backing cloth follower 8 in the inlet region, preferably in vicinity of a roller 10. The foam can be applied to the backing cloth follower 8, for example, by means of a slit nozzle 15 extending parallel to the axis of the roller 10. A wiper or doctor 16 is then suitable for evenly or uniformly distributing or equalizing the foam.

From the point of application at the wiper 16, the foam 17 travels together with the backing cloth follower 8 through the inlet region to the region where the backing cloth follower 8 meets or runs together with the planar structure 9 at the surface 6 of the cylinder shell 1 and is transferred to the planar structure 9 respectively during or after the running together of the backing cloth follower 8 and the planar structure 9. Depending upon the choice of the thickness of the applied foam layer 17, a uniform treatment, which is either complete or encompasses part of the layer thickness of the planar structure 9 can be attained in the manner described hereinbefore.

In the region in which the backing cloth follower 8 meets or runs together with the planar structure 9, the danger exists that the foam may back up or become dammed, so that it becomes difficult to control the application of the foam accurately. It may therefore be advantageous to apply the vacuum which acts from the interior of the cylinder to a sector of the periphery of the cylinder shell 1 which is encompassed in FIG. 1 of the drawing by the angle $\beta$ and not covered by the backing cloth follower 8, before the backing cloth follower 8 and the planar structure 9 run together, so that the foam which is to be applied or brought to the planar structure 9 or already lies on it, is attracted or drawn to the textile material already in this region.

The cover layer or support layer 7, which is to be arranged advantageously directly on the surface 6 of the cylinder shell 1, has the purpose of achieving uniform distribution of the vacuum directed through the holes 5 to the surface 6 of the cylinder shell 1. This support layer 7 may, for example, be a wire screen fabric which is connected to the surface 6 by means of strips 18. The strips 18 should extend substantially parallel to the axis 3 of the cylinder shell 1 in order to prevent the development of a suction pull in peripheral direction of the cylinder.

We claim:

1. Method of continuously applying a foamed treatment medium to a planar textile structure which comprises applying the foam directly to the surface of an air-impermeable planar follower, guiding the planar follower synchronously into areal contact with the planar textile structure, and transferring the foam from the surface of the planar follower into the planar textile structure while the planar follower and the planar textile structure are in areal contact by applying vacuum to a side of the planar textile structure opposite the air-impermeable planar follower.

2. Method according to claim 1 wherein the foam applied to the planar follower is transferred, after the planar follower has run together with the planar textile structure, to the planar textile structure in an evacuated chamber having a pressure which is low compared to the internal pressure of the bubbles of the foam.

3. Method according to claim 2 which comprises exerting a suction pull on the foam disposed on the planar follower shortly before the planar follower and the planar textile structure have run together.

4. Method according to claim 1 wherein the foam is applied to the planar follower by wiping it thereon with a layer thickness adequate for impregnating the planar textile structure.

5. Method according to claim 1 which comprises guiding the planar follower, over a drum having, at the surface thereof, a support layer subjected to vacuum, guiding the planar textile structure between the shell of the drum and the planar follower and running the planar textile structure, considerably before the planar follower, onto the drum shell, and exerting suction pressure on the foam disposed on the planar follower from a peripheral section of the drum disposed ahead of a line at which the planar follower runs up on the drum shell.

6. Apparatus for performing a method of continuously applying a foamed treatment medium to a planar textile structure comprising a drum having, at the shell surface thereof, an evacuatable support layer, an air-impermeable planar follower spanning part of the drum periphery in areal contact with and for guiding the planar textile structure on the drum shell surface, said planar follower having an inlet section supported by at least one roller, means disposed at said inlet section for supplying foam to be applied between said planar textile structure and said planar follower, a wiper disposed opposite said one roller for uniformly distributing foamed treatment applied to the planar follower region preceding said wiper means for supplying suction through said support layer to a side of the planar textile structure opposite said air-impermeable planar follower, and means for separating the planar textile structure and the planar follower from one another.

7. Apparatus according to claim 6 wherein said drum has a peripheral section forward of a run-up line at which said planar follower runs up on said drum, said peripheral section being uncovered by said planar follower, yet subjectible to suction pull.

8. Apparatus according to claim 6 wherein said air-impermeable planar follower is formed of smoothly ground rubber.

* * * * *